US009434595B2

(12) United States Patent
Peirsman et al.

(10) Patent No.: US 9,434,595 B2
(45) Date of Patent: Sep. 6, 2016

(54) KEG CONNECTOR

(71) Applicants: Daniel Peirsman, Brussels (BE); Vanessa Valles, Brussels (BE); Stijn Vandekerckhove, Brussels (BE)

(72) Inventors: Daniel Peirsman, Brussels (BE); Vanessa Valles, Brussels (BE); Stijn Vandekerckhove, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 14/435,139

(22) PCT Filed: Oct. 11, 2013

(86) PCT No.: PCT/EP2013/071310
§ 371 (c)(1),
(2) Date: Apr. 10, 2015

(87) PCT Pub. No.: WO2014/057099
PCT Pub. Date: Apr. 17, 2014

(65) Prior Publication Data

US 2015/0266713 A1 Sep. 24, 2015

(30) Foreign Application Priority Data

Oct. 11, 2012 (EP) ..... 12188108

(51) Int. Cl.
*B67D 1/08* (2006.01)
*B67D 1/04* (2006.01)

(52) U.S. Cl.
CPC ..... *B67D 1/0841* (2013.01); *B67D 1/0406* (2013.01); *B67D 1/0462* (2013.01); *B67D 1/0829* (2013.01); *B67D 1/0839* (2013.01); *Y10T 137/314* (2015.04)

(58) Field of Classification Search
CPC B67D 1/0841; B67D 1/0462; B67D 1/0839; B67D 1/04; B67D 1/0829; Y10T 137/314
USPC ..... 222/394, 399, 400.7, 80–86, 89; 137/212; 285/326, 87
See application file for complete search history.

(56) References Cited

U.S. PATENT DOCUMENTS 569,800 A * 10/1896 Post ..... B67D 1/0832 222/400.7
569,801 A * 10/1896 Post ..... B67D 1/0832 222/400.7

(Continued)

FOREIGN PATENT DOCUMENTS

CA 2012647 9/1990
EP 0 444 596 2/1991

(Continued)

*Primary Examiner* — Donnell Long
(74) *Attorney, Agent, or Firm* — Levy & Grandinetti

(57) ABSTRACT

A keg connector is disclosed for fluidly connecting the interior of a bag-in-container type keg with a dispensing tube connected to a dispensing valve in a tapping column and pressure gas tube connected to a pressurized gas source. The keg connector has a base body and is coupled firmly and releasably to the keg closure. The keg connector has a dispense connector and gas connector having a substantially straight dispense tip and gas tip, respectively, each extending along a longitudinal axis, Z, in fluid communication with a second end respectively connectable to a dispense tube in fluid communication with a tapping column and valve and gas tube in fluid communication with a pressurized gas source. A lever is provided for sequentially driving in a single movement firm coupling of the keg connector to the keg closure and penetration of the dispense and gas tips into the corresponding openings.

20 Claims, 4 Drawing Sheets

(56) References Cited

U.S. PATENT DOCUMENTS

| | | | | |
|---|---|---|---|---|
| 2,051,981 | A * | 8/1936 | Bowman | B67D 1/0425 141/19 |
| 3,228,413 | A | 1/1966 | Stevens | |
| 3,374,927 | A | 3/1968 | Schmidt | |
| 3,527,391 | A | 9/1970 | DiMuria | |
| 3,545,475 | A | 12/1970 | Johnson | |
| 3,905,522 | A | 9/1975 | Johnston | |
| 4,089,444 | A | 5/1978 | Shea | |
| 4,699,298 | A | 10/1987 | Grant et al. | |
| 6,386,403 | B2 * | 5/2002 | Parsons | B67D 7/0238 222/181.3 |
| 8,070,023 | B2 * | 12/2011 | Vitantonio | B67D 1/0418 222/396 |
| 2002/0050498 | A1 * | 5/2002 | Celli | B67D 1/0839 222/400.7 |

FOREIGN PATENT DOCUMENTS

| | | |
|---|---|---|
| EP | 0 905 044 | 3/1999 |
| EP | 2 146 832 | 10/2008 |
| EP | 2 148 770 | 10/2008 |
| EP | 2 148 771 | 10/2008 |
| EP | 2 152 486 | 10/2008 |
| EP | 23 152 494 | 10/2008 |
| WO | WO 94/07791 | 4/1994 |
| WO | WO 2008/101503 | 8/2008 |
| WO | WO 2009/090223 | 7/2009 |
| WO | WO 2009/090224 | 7/2009 |
| WO | WO 2010/031764 | 3/2010 |
| WO | WO 2011/006212 | 1/2011 |
| WO | WO 2012/004223 | 1/2012 |

* cited by examiner

KEG CONNECTOR

This Application is the U.S. National Phase of International Application Number PCT/EP2013/071310 filed on Oct. 11, 2013, which claims priority to European Application Number 12188108.0 filed on Oct. 11, 2012.

TECHNICAL FIELD

The present invention concerns a keg connector for connecting dispensing tube and pressurized gas tube to a keg, typically a beer keg, mounted in a dispensing appliance comprising a tap column. The present keg connector allows easy, reliable and reproducible connection to a beverage keg in a single movement of a dispense tube in fluid communication with a tapping valve mounted in a tapping column and a gas tube in fluid communication with a source of pressurized gas.

BACKGROUND OF THE INVENTION

Traditionally beer, cider and other fermented beverages are served in public houses, bars, and restaurants directly from a keg connected to a tapping column by a dispense tube. Dispensing of the beverage is driven by a source of pressurized gas in fluid communication with the interior of the keg by means of a gas tube, such as to raise the pressure inside the keg above atmospheric pressure and at a level sufficient for driving the beverage from the keg up to the tapping column via the dispense tube. Beverage flow is controlled by a tapping valve located at the top portion of the column.

In traditional systems, beverage is contained in a keg, leaving an headspace above the liquid which is pressurized with gas, such as $CO_2$. A hollow sword in fluid communication with the dispense tube and comprising an opening at the bottom thereof is immersed in the beverage to allow the liquid to flow out through the dispense tube and tapping valve when open. In this configuration, keg connectors comprising co-axial or adjacent gas and dispense tube connectors are generally used as disclosed e.g., in WO9407791, U.S. Pat. No. 3,545,475, or WO2008101503. A recurrent problem with such traditional kegs, is that since the pressurized gas contacts the beverage, some gas will dissolve into the beverage and affect the taste thereof. It follows that the taste of the beverage may vary from one dispensing to another depending on the pressure inside the keg and filling level of the liquid in the keg.

To avoid contact of the pressurizing gas with the beverage, bag-in-containers comprising an inner, collapsible bladder or bag containing the beverage to be dispensed, which is contained in an outer, more rigid container have been used. Recently, cost effective bag-in-containers have been developed allowing their extensive use in mass consumer goods such as beer kegs, cider kegs, and the like (cf. e.g., EP2146832, EP2148770, WO2010/031764, EP2152494, EP2152494, EP2152486, EP2152486, EP2148771).

Contrary to traditional kegs, the dispense tube and gas tube in bag-in-containers need be connected to separate parts of the keg, the former in fluid communication with the interior of the inner bladder, and the latter with the headspace between the bladder and the outer container. Note that the use of a dispense sword is not mandatory with bag-in-container types of kegs, contrary to conventional kegsTo this effect, bag-in-container type of kegs are usually provided with a closure comprising two separate openings: a dispense opening in contact with the interior of the inner bladder and a gas opening in contact with the headspace between inner bladder and outer container. Examples of closures suitable for bag-in-container types of kegs are disclosed in WO2009/090224, WO2009/090223, WO2012004223. It is clear that with such design the traditional keg connectors discussed above cannot be used. CA2012647 proposes a simple solution by providing a bung provided with two openings with corresponding valves and coupling means for independently coupling a dispense tube and a gas tube. For example, snap fit connections as disclosed in EP0905044 can be used as coupling means. This solution has the inconvenient that each tube must be connected one after the other which is long and tedious and the tubes could be coupled to the wrong opening.

To simplify the coupling operation, WO2011006212, EP0444596, U.S. Pat. Nos. 4,699,298, 4,089,444, 3,905,522, 3,527,391, and 3,228,413 propose keg connectors comprising a clamp ring provided with an inner screw thread mating an external screw thread provided in the keg neck or closure. As the clamp ring is being screwed tight, the dispense tip and gas tip of parallel and separate dispense and gas connecting means are driven down through the dispense opening and gas opening provided in the keg closure. The problem with threaded clamp rings is that one is never sure whether the keg connector is fully coupled to the keg or not and also that, since the penetration of the dispense tip and gas tip through the originally sealed dispensing opening and gas opening may require some force, the required force is not always easy to provide by a screwing movement in a generally uncomfortable position. The maximum leverage afforded by a screw type clamp ring is limited to the size of grasp of a human hand, i.e., ca 10-15 cm) which is quite insufficient for the levels of forces required.

U.S. Pat. No. 3,374,927 discloses a keg connector suitable for bag-in-containers, comprising a latch member provided with a handle allowing the keg connector to be coupled to the container. Once the keg connector is firmly coupled to the keg, the tips of dispense and gas connecting means are pressed down by hand to pierce corresponding sealed openings. Although the handle gives leverage which facilitates coupling of the connector, the manual pressing down of the dispense and gas connecting means remains uncomfortable.

The present invention provides a keg connector particularly suitable for bag-in-container types of kegs, which can be coupled very easily to such kegs. This and other advantages of the present invention are presented in continuation.

SUMMARY OF THE INVENTION

The present invention is defined in the appended independent claims. Preferred embodiments are defined in the dependent claims. In particular, the present invention concerns a keg connector for fluidly connecting the interior of a bag-in-container type of keg with a dispensing tube connected to a dispensing valve in a tapping column, and with a pressure gas tube connected to a source of pressurized gas, said keg connector comprising a base body and further comprising the following elements:

(a) Coupling means for firmly and releasibly coupling the keg connector to the neck of a keg or to the closure of said keg;

(b) A dispense connector comprising a substantially straight dispense tip extending along a longitudinal axis, Z, in fluid communication with a second end connected or connectable to a dispense tube in fluid communication with a tapping column and valve, (c) A gas connector, comprising a substantially straight gas tip extending along said longitudinal axis, Z, and physically separate from the dispense tip, said gas tip being in fluid communication with a second end connected to a gas tube connectable to a source of pressurized gas, (d) Coupling actuating means for reversibly bringing the coupling means from an uncoupled to a coupled position, in which the keg connector is firmly coupled to the keg neck or keg closure, with the dispense tip and gas tip facing corresponding dispense opening and gas opening provided on said keg closure, (e) Penetration actuating means for simultaneously and reversibly moving by a given distance along the longitudinal axis, Z, the dispense tip and gas tip from a first retracted position, Z0, to a second connected position, Z2, wherein said distance is sufficient for the dispense tip and gas tip to penetrate into the corresponding dispense opening and gas opening provided on the keg closure, Characterized in that, coupling and penetration actuating means are a single actuating means suitable for sequentially driving in a single movement:

in a first step, firm coupling of the keg connector to the keg neck or keg closure followed, in a second step, by the penetration of the dispense tip and gas tip into the corresponding dispense and gas openings (44, 66).

The single actuating means preferably comprises a lever pivotally mounted on said base body. In a preferred embodiment, as the actuating means are being actuated, e.g., a lever is pivoted about its hinges, until the coupling means have reached their coupled position, the dispense tip and gas tip have moved along the longitudinal axis, Z, by an intermediate distance Z1<Z2, wherein said intermediate distance, Z1, is less than the distance required by the dispense tip and gas tip to penetrate through the corresponding dispense and gas openings of the keg's closure for which the keg connector is designed (i.e., at this stage no fluid communication has been established by the tips with the interior of the keg). This is advantageous, because the penetration of the dispense tip and gas tip into the corresponding dispense and gas opening of the closure require some force, sometimes a seal must be pierced, and it is important that the keg connector be firmly coupled to the container or container closure before a penetration force is applied.

It is advantageous if the coupling means comprises a first and second latches pivotally mounted on hinges disposed on opposite sides of the keg connector base body, one free end of each of said latches ending in a protrusion extending towards each other, such that actuation of the single actuating means varies the distance, D, separating the tips of each protrusion from an uncoupled distance, D0, greater than at least one dimension of the keg's neck or keg's closure for which the keg connector is designed, such that the keg connector can be freely moved in the longitudinal direction, Z, until reaching its coupling position to said keg, to a coupled distance, D1<D0, smaller than a dimension of the keg's neck or keg's closure such that the keg connector is firmly fixed to said keg's neck or keg's closure. The dispense and gas connectors are preferably supported on a support element movable in the longitudinal direction, Z, with respect the keg connector base body, said support element being interconnected with each latch, such that moving the support element along the longitudinal direction, Z, from said retracted position, Z0, to said intermediate position, Z1, drives the latches to pivot about their respective hinges such that the distance between the tips of the latch protrusions is decreased from the uncoupled distance, D0, to the coupled distance, D1. It is further preferred if by moving the support element further along the longitudinal direction, Z, from said intermediate position, Z1, to said connected position, Z2, the coupled distance, D1, between the tips of the latch protrusions does not vary, whilst the dispense tip and gas tip continue their translation along the longitudinal axis, Z until they enter into fluid communication with the interior of the container.

The interconnection between the support element and the latches is preferably in the form of either:

(a) A curved sliding surface of the latches engaged in corresponding openings of the support element, or (b) A pin provided on the support element engaged in an opening in the shape of a curved bean slot provided on a latch, or (c) A pin provided on a latch engaged in an opening in the shape of a curved bean slot provided on the support element, The geometries of the bean shaped slots or sliding surfaces being such that the linear movement of the support element along the longitudinal axis, Z, generates the desired pivoting movement of the latches.

It particular, for pin/slot interconnection types (cf. (b)&(c) supra) it os preferred that each latch comprises in its portion comprised between the two ends, either:

(i) a bean shaped slot) engaged in a pin, said pin being mechanically coupled to the support element supporting the dispense and gas connectors, or (ii) a pin engaged in a bean shaped slot, said bean shaped slot being provided on the support element supporting the dispense and gas connectors;

the bean shaped slot according to geometries (i) or (ii) having:

a curved portion, such that the relative movement in the Z-direction between positions Z0 and Z1 of the pins running along the curved portion of said bean shaped slots drives the pivoting of the latches (5), and a substantially straight portion, such that the relative movement in the Z-direction between positions Z1 and Z2 of the pins running along the straight portion of said bean shaped slots does not affect the position of the latches (5

Each latch is preferably pivotally mounted on a hinge. The hinge can be positioned either at or adjacent the latch end opposite the end comprising the protrusion or, in an alternative embodiment, in its intermediate section comprised between the two ends thereof, thus defining a first, lower latch section comprised between the hinge and the end provided with the protrusion, and a second, upper latch section comprised between the hinge and the latch second end. The latter latch geometry allows to provide said second, upper section with a sliding surface having a specific curvature, the second section of each latch being inserted in a slot provided on the support element supporting the dispense and gas connectors, such that as the slots receiving the second portion of each latch move along the longitudinal axis, Z, they slide down the curved surface of the second portion of each latch, the slots and sliding surfaces having a geometry and dimensions such that as the support element has moved from the retracted position, Z0, to the intermediate position, Z1, the tip of the latch protrusions are brought closer together from an uncoupled distance, D0, to a coupled distance, D1, and such that as the support element further moves down from the intermediate position, Z1, to the connected position, Z2, the latches do not pivot anymore.

The same design can be used with a pin and bean shaped slot according to embodiments (b) or (c).

The present invention also concerns a beverage dispensing device comprising:

(a) A keg, preferably a bag-in-container type of keg, containing a beverage and comprising a closure provided with a dispense opening separate from a gas opening, (b) A source of pressurized gas in fluid communication with the keg by a gas tube, (c) A tapping column comprising a tapping valve in fluid communication with the keg by a dispense tube, wherein the dispense tube and gas tube are coupled to the keg by means of a keg connector as defined supra.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
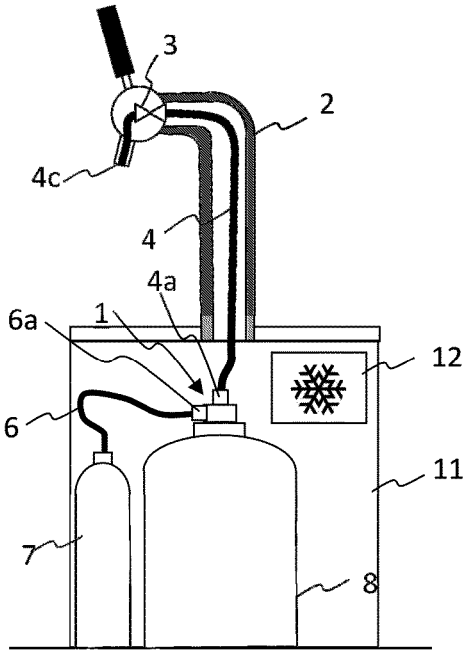
FIG. 1: shows a beverage dispensing device according to the present invention.
Figure 5:
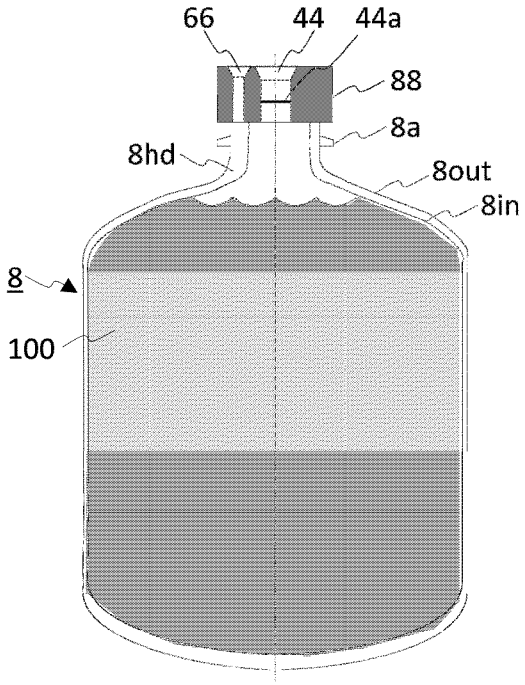
FIG. 5: shows an example of bag-in-container type of keg.

As illustrated in FIG. 1, a beverage dispensing device according to the present invention is of the type comprising a keg (8) containing a liquid to be dispensed. The keg may be stored in a compartment (11) provided with refrigerating means (12). The keg is preferably a bag-in-container type of keg. The keg comprises an opening closed by a closure (88) provided with two openings: a dispense opening (44) suitable for bringing in fluid communication ambient atmosphere with the interior of the container, in particular the interior of the inner bladder (8*in*) containing the beverage (100) for bag-in-container types of kegs (cf. FIG. 5), and a gas opening (66) suitable for bringing in fluid communication external atmosphere with the interior of the container, in particular the headspace (8*hd*) comprised between the inner bladder (8*in*) and the outer container (8*out*) for bag-in-container types of kegs. The dispense opening (44) and possibly the gas opening (66) may be sealed prior to use with sealing element (44*a*, 66*a*). In the Figures, the seal is schematically represented by a straight line, but it is clear that it can have many geometries known in the art. The dispense and gas openings (44, 66) are preferably provided with sealing rings (not shown) for insuring a fluid tight contact with the dispense and gas tips (4*b*, 6*b*) when coupled to the keg connector (1).

The beverage dispensing device of the present invention also comprises a source of pressurized gas (7) connected by a gas tube (6) in fluid communication with the interior of the keg, in particular the headspace (8*hd*) comprised between the inner bladder (8*in*) and the outer container (8*out*) for bag-in-container types of kegs. The source of pressurized gas (7) is used to increase the pressure inside the keg, above atmospheric pressure, in order to drive the flow of beverage (100) through the dispense opening (44). A dispense tube (4) coupled to the dispense opening (44) ensures fluid communication between the interior of the keg, in particular the interior of the inner bladder (8*in*) containing the beverage (100) for bag-in-container types of kegs, and ambient atmosphere at its opposite end (4*c*). In order to control the flow of beverage out of the dispensing tube end (4*c*), the dispense tube (4) is coupled to a tapping valve (3) located at the top portion of a tapping column (2) of any type commonly used in public houses, bars, and restaurants. The beverage dispensing device of the present invention is characterized in that the dispense tube (4) and gas tube (6) are coupled to the keg (8) by means of a particular keg connector (1) described more in detail in continuation.

Figure 6:
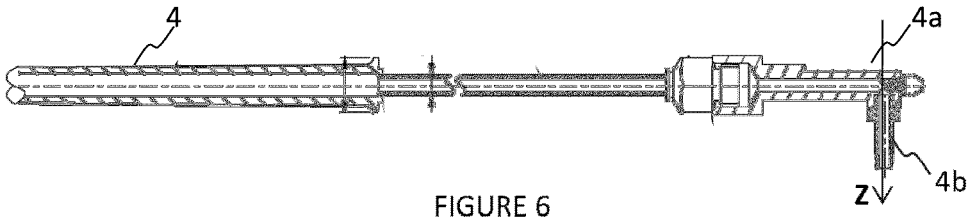
FIG. 6: shows a dispense line connected to a dispense connector provided with a dispense tip.
Figure 2:
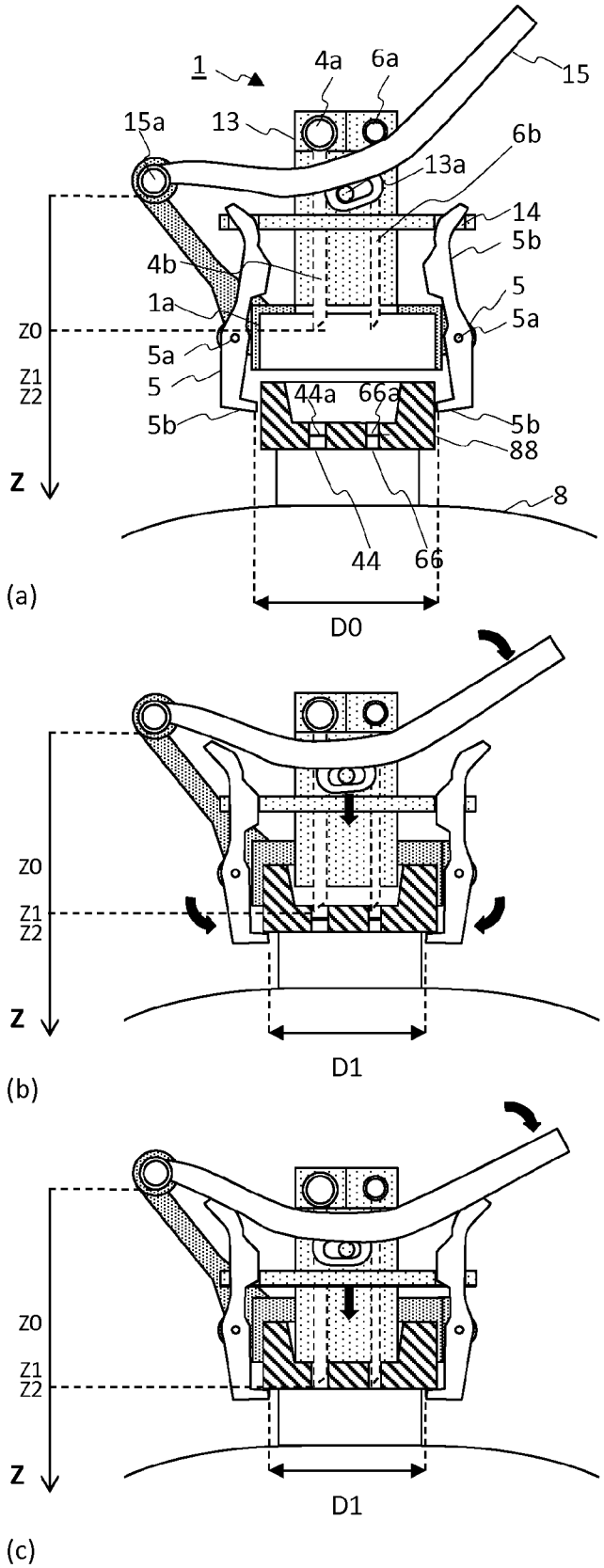
FIG. 2: shows a first embodiment of keg connector according to the present invention.
Figure 3:
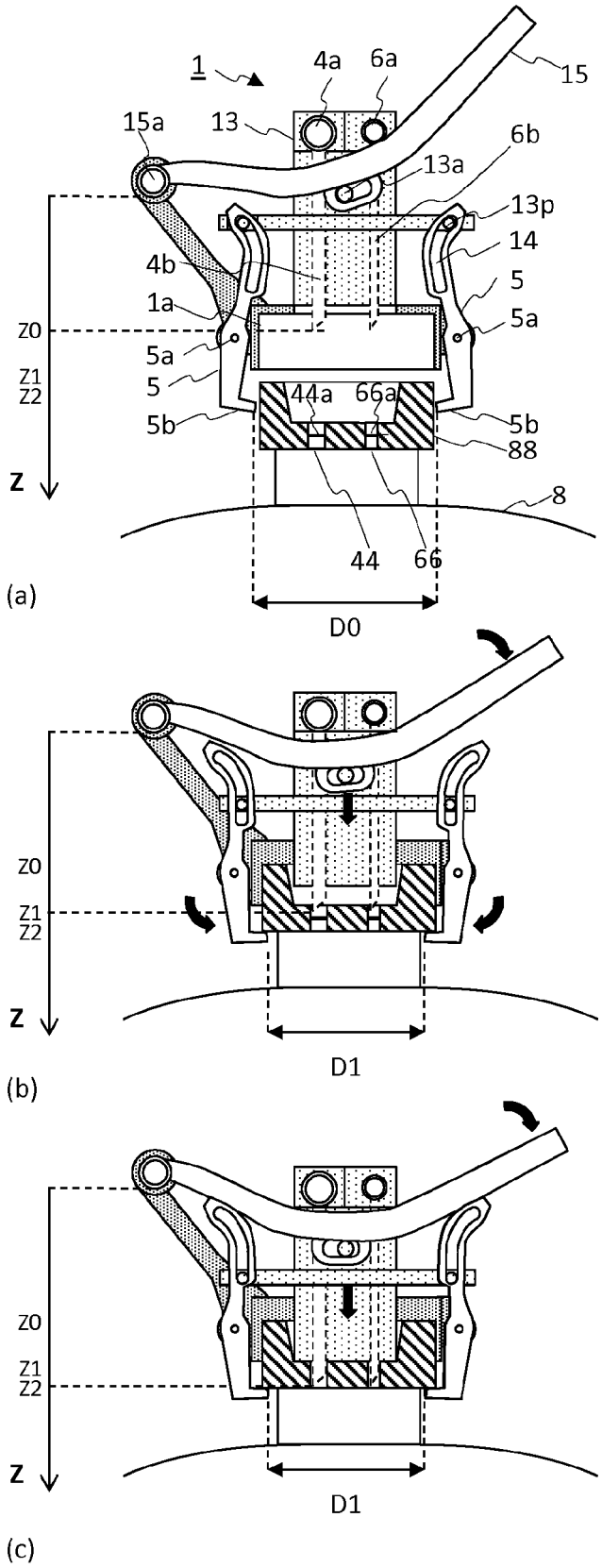
FIG. 3: shows a second embodiment of keg connector according to the present invention.
Figure 4:
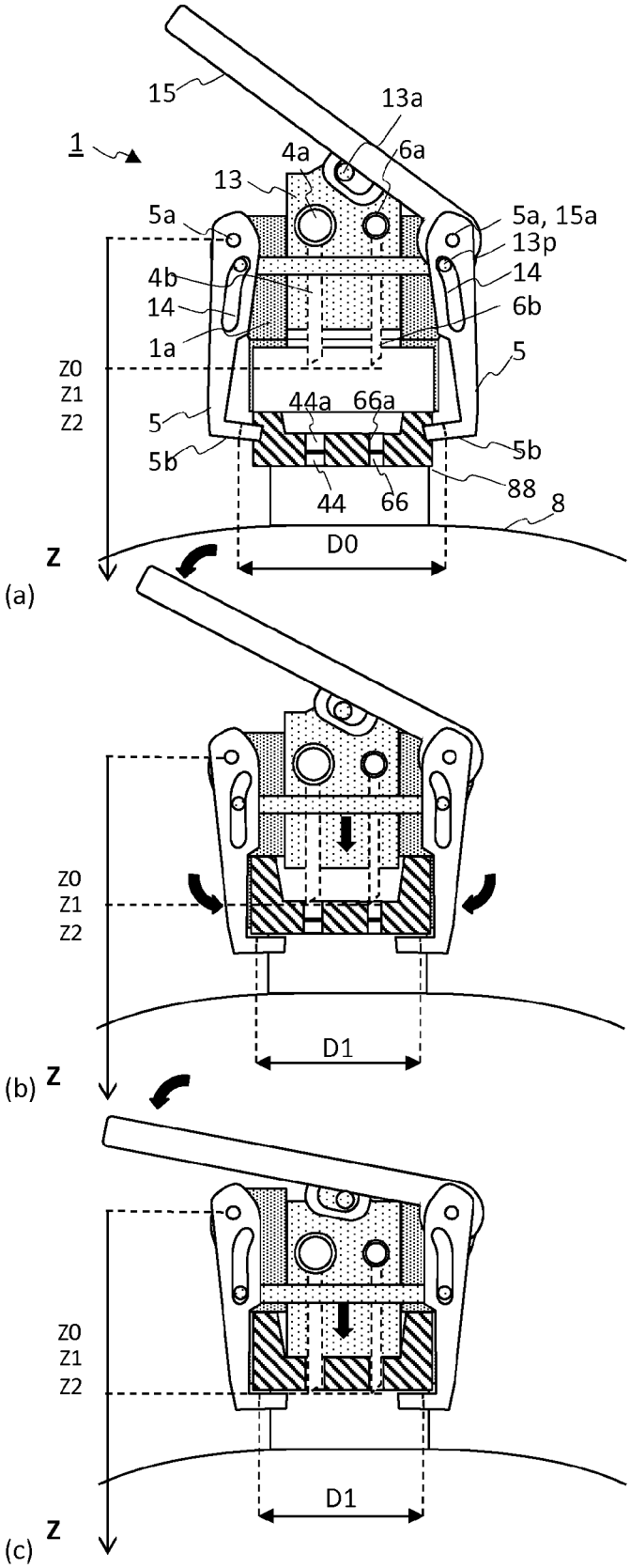
FIG. 4: shows a third embodiment of keg connector according to the present invention.

A keg connector according to the present invention is particularly suitable for connecting a dispense tube (4) and gas tube (6) to a bag-in-container type of keg in a very simple, easy, and reliable manner. FIGS. 2 to 4 illustrate some preferred embodiments of keg connectors according to the present invention. The keg connector comprises a base body (1*a*) provided with an interface suitable for engaging the closure (88) of a keg (8). The various elements of the keg connector (1) are mounted on said base body (1*a*). Coupling means (5) are mounted on said base body, 1*a*) for firmly and reversibly coupling the keg connector (1) to the neck (8*a*) of a keg (8) or to the closure (88) of said keg. The keg connector (1) receives a dispense connector (4*a*) and a gas connector (6*a*) which are connected to a dispense tube (4) and gas tube (6), respectively. An example of dispense connector (4*a*) is illustrated in FIG. 6. A gas connector (6*a*) has similar geometry, and the features described with respect to the dispense connector (4*a*) apply mutatis mutandis to the gas connector (6*a*). The dispense and gas connectors (4*a*, 6*a*) each comprises a substantially straight dispense tip (4*b*, 6*b*) extending along a longitudinal axis, Z, and suitable for penetrating and, if it applies, piercing a dispense opening (44) and gas opening (66) of the closure (88) of the keg (8). The gist of the present invention is that a single actuating means (15) allows with a single movement:

(a) To reversibly bring the coupling means (5) from an uncoupled to a coupled position, in which the keg connector is firmly coupled to the keg neck (8*a*) or keg closure (88), with the dispense tip (4*b*) and gas tip (6*b*) facing without penetrating corresponding dispense opening (44) and gas opening (66) provided on said keg closure; and (b) To reversibly move by a given distance along the longitudinal axis, Z, the dispense tip (4*b*) and gas tip (6*b*) from a first retracted position, Z0, to a second connected position, Z2, wherein said distance is sufficient for the dispense tip (4*b*) and gas tip (6*b*) to penetrate into the corresponding dispense opening (44) and gas opening (66) provided on the keg closure (88), and thus establish fluid communication with the interior of the container.

It is important that the coupling means (5) be in their coupled position before the dispense tip (4*b*) and gas tip (6*b*) have engaged the corresponding dispense and gas openings (44, 66) with any significant force to either tear open a seal or to force the passage through a resilient sealing ring (not shown). If this happened before the coupling means (5) were in their coupled position, the keg connector would risk to be disengaged from the keg neck (8*a*) or keg closure (88). For this reason it is preferable that, as the coupling means (5) reaches their coupled position, the dispense tip (4*b*) and gas tip (6*b*) have moved along the longitudinal axis, Z, by an intermediate distance Z1<Z2, wherein said intermediate distance, Z1, is less than the distance required by the dispense tip (4*b*) and gas tip (6*b*) to penetrate through the corresponding dispense and gas openings (44, 66) of the keg's closure (88) for which the keg connector is designed. Thereafter, the coupling means maintain their coupled position, and the dispense and gas tips (4*b*, 6*b*) continue their translation along the longitudinal direction, Z, from their intermediate position, Z1, to their connected position, Z2, to establish fluid communication with the interior of the keg.

In a preferred embodiment, the coupling means comprises a first and second latches (5) pivotally mounted on hinges (5*a*) disposed on opposite sides of the keg connector base body (1*a*), one free end of each of said latches ending in a protrusion (5*b*) extending towards each other. The protrusions (5*b*) have a geometry suitable for mating a surface of the keg neck they are designed for. Upon actuation of the single actuating means (15) the distance, D, separating the tips of each protrusion (5*b*) is varied from an uncoupled distance, D0, greater than at least one dimension of the keg's neck or keg's closure for which the keg connector is designed, such that the keg connector can be freely moved in the longitudinal direction, Z, until reaching its coupling position to said keg, to a coupled distance, D1<D0, smaller than a dimension of the keg's neck or keg's closure such that the keg connector is firmly fixed to said keg's neck or keg's closure.

The dispense and gas connectors (4*a*, 6*a*) are preferably supported on a support element (13) movable in the longitudinal direction, Z, with respect to the keg connector base body (1*a*). Said support element (13) is interconnected with each latch (5), such that by moving the support element (13) along the longitudinal direction, Z, from said retracted position, Z0, to said intermediate position, Z1, the latches (5) are driven to pivot about their respective hinges (5*a*) such that the distance between the tips of the latch protrusions (5*b*) is decreased from the uncoupled distance, D0, to the coupled distance, D1. Upon moving the support element (13) further along the longitudinal direction, Z, from said intermediate position, Z1, to said connected position, Z2, the distance between the tips of the latch protrusions remains substantially constant at their coupled distance value, D1.

The single actuating means (15) is preferably a lever, pivotally mounted on the base body (1*a*) of the keg connector with a hinge (15*a*). It is preferably interconnected with the support element (13) supporting the dispense and gas connectors (4*a*, 6*a*) such that pivoting the lever up or down about its hinge (15*a*) drives the support element up or down with respect to the base body (1*a*) along the longitudinal direction, Z, between its retracted position, Z0 and its coupled position, Z2, passing by its intermediate position, Z1. The connection between the lever (15) and the base body (1*a*) is preferably of the type of a pin (13*a*) engaged in a bean shaped slot, so that the rotational movement of the lever about its hinge (15*a*) can be translated into a rectilinear translation of the support element (13) along the Z-direction. Other connection types can be envisages, such as a hinged rod, as long as it permits to transmit a linear motion to the support element (13). Guiding means (not shown) such as rails, or mating protrusion/groove systems can be provided to guide along the longitudinal direction, Z, the translation of the support element with respect to the base body (1*a*). A lever is advantageous, because it allows the application of considerable forces with little efforts from an operator. This is important because, on the one hand, high forces may be required for the coupling because the keg is pressurized and tight sealing elements and coupling forces are required to maintain the system gas tight and, on the other hand, the operator is often in an uncomfortable position, crouched under the counter in often dark and noisy environments.

As explained supra, the rotational movement of the lever (15) about its hinge (15*a*) drives the linear movement along axis Z of the support element (13) with respect to the base body (1*a*) through the connection (13*a*) between them. In a preferred embodiment, the support element (13) is interconnected with the latches (5) such that the linear translation up and down along the longitudinal direction, Z, between the retracted position, Z0, and the intermediate position, Z1, of the support element (13) drives the pivoting of the latches (5) from their uncoupled position, D0, when the support element is at its retracted position, Z0, to its coupled position, D1, when the support element is at its intermediate position, Z1. The connection between the latches (5) and the support body (13) is also such that moving the latter along the Z-direction between its intermediate position, Z1, and its connected position, Z2, does not affect the position of the latches (5) anymore, which maintain their coupled configuration, D1.

The interconnection between the support element (13) and the latches (5) can be in the form of either:

(a) A curved sliding surface (5*b*) of the latches (5) engaged in corresponding openings (14) of the support element (13) (cf. FIG. 2), (b) A pin (13*p*) provided on the support element (13) engaged in an opening (14) in the shape of a curved bean slot provided on a latch (5) (cf. FIGS. 3&4), or (c) A pin provided on a latch (5) engaged in an opening (14) in the shape of a curved bean slot provided on the support element (13) (not shown), The geometries of the bean shaped slots or sliding surfaces are such that the linear movement of the support element (13) with respect to the base body (1*a*) along the longitudinal axis, Z, generates the desired pivoting movement of the latches. For example, in the embodiments illustrated in FIGS. 2 and 3, each latch (5) is pivotally mounted on a hinge (5*a*) in its intermediate section comprised between the two ends thereof, thus defining:

(a) a first, lower latch section comprised between the hinge (5*a*) and the end provided with the protrusion (5*b*), and (b) a second, upper latch section comprised between the hinge (5*a*) and the latch second end.

In the embodiment of FIG. 2, the second, upper section of each latch (5) comprises a sliding surface (5*b*) having a specific curvature which is engaged in a slot (14) provided at appropriate positions on the support element (13) supporting the dispense and gas connectors (4*a*, 6*a*), such that as the support element (13) moves along the Z-direction, the slots (14) receiving the second portion of each latch (5) slide along the curved surface (5*b*) of the second upper portion of each latch. The slots (14) and the sliding surfaces (5*b*) have a geometry and dimensions such that as the support element (13) and slots (14) have moved with respect to the latches from the retracted position, Z0, to the intermediate position, Z1, the tip of the latch protrusions (5*b*) are brought closer together from an uncoupled distance, D0, to a coupled distance, D1. As illustrated in FIG. 2, the clamping of the latches is triggered by the slots (14) sliding along the first inner protrusion of the curved surface (5*b*) located between the positions of the slots (14) in FIGS. 2(*a*) and 2(*b*). The geometry of the curved surface (5*b*) must also be such that as the support element further moves down from the intermediate position, Z1, to the connected position, Z2, the latches (5) do not pivot anymore. This is easily achieved by providing a straight surface portion (5*b*) extending parallel to the Z-direction along which the slots (14) can run freely, as shown in FIG. 2(*b*)&(*c*)

The embodiment of FIG. 3 is very similar to the one of FIG. 2, with the exception that the slots (14) are now provided on the latches (5), whilst pins (13*p*) mounted on the support element (13) are engaged in such slots (14). As can be appreciated in FIG. 3, the slots (14) comprise a top portion which is curved such that the translation of the pins (13*p*) along the Z-direction drives the pivoting of the latches (5) about their hinges (5*a*) such that the protrusions (5*b*) of the latches are brought closer together from an uncoupled distance, D0 to a coupled distance, D1 (cf. FIG. 3(*a*)&(*b*)). The length of the curved top portions of the latches (5) projected over an axis Z is equal to the difference Z1−Z0. The slots (14) comprise a lower portion which is rectilinear, and extends parallel to the Z-direction when the latches are in their coupled position, D1, such that the translation of the pins (13*p*) along the Z-direction between the intermediate position, Z1, and the connected position, Z2, does not affect the distance, D, between the latch protrusions (5*b*). At the same time, the dispense and gas tips (4*b*, 6*b*) have engaged and fully penetrated the dispense and gas openings (44, 66) of the closure (88), when the support element (13) has reached the connected position, Z2, thus establishing fluid communication between the interior of the container (8) and the dispense and gas tubes (4, 6).

In the embodiments of FIGS. 2 and 3, the top, inner surface of the latches (5) has such geometry that when the lever (15) is at its lowest position, corresponding to the connected position, Z2, of the support element (13), the lever rests on said top inner surfaces thus blocking the latches in their coupled position. This adds a level of safety in preventing any risk of the latches suddenly opening and un-coupling the keg connector (1) from the closure (8) or the keg neck (8*a*).

In an alternative configuration, an embodiment thereof being illustrated in FIG. 4, each latch is hinged (5*a*) at its end opposite the end comprising a protrusion (5*b*). The lever (15) is preferably, bur bot necessarily, hinged at the same hinge (15*a*, 5*a*) as one of the latches as illustrated in FIG. 4. As in the former embodiments (cf. FIGS. 2&3) the lever is also coupled (13*a*) to a support element (13) such that rotating up and down the lever about its hinge (15*a*) drives the translation of the support element (13) along the Z-direction. The support element (13) supports the dispense and gas connectors (4*a*, 6*a*) such that the dispense and gas tips (4*b*, 6*b*) are oriented with their axes extending parallel to the longitudinal direction Z. The support element is coupled to the latches by means of a pin (13*p*) engaged in a bean shaped slot (14). As illustrated in FIG. 4, the pins (13*p*) can be mounted on the support element (13) and the bean shaped slot (14) on the latches, but it is clear that the pin can be part of the latches and the slots be part of the support element with the same effect. Upon moving the support element (13) along the Z-direction between the retracted position, Z0, and intermediate position, Z1, the pins (13*p*) run along a curved portion of the bean shaped slots (14) which have a geometry such that the latches are driven to pivot about their hinges (5*a*) from an uncoupled position, D0, to a coupled position, D1 (cf. FIG. 4(*a*)&(*b*)). As the support element (13) moves further from the intermediate position, Z1 to the connected position, Z2, the pins move relative a straight portion of the bean shape slots (14) extending parallel to the Z-direction, such that the position of the latches is not affected by the displacement of the support element (13) (cf. FIG. 4(*b*)&(*c*)).

An embodiment of dispense connector (4*a*) connected at one end to a dispense tube (4) and provided at the other end with a dispense tip (4*b*) is illustrated in FIG. 6. A gas connector (6*a*) has a similar geometry as the dispense connector (4*a*) and a second illustration of the gas connector (6*a*) is not required. The dispense and gas connectors (4*a*, 6*a*) are coupled to the support element (13) such that the dispense tip (4*b*) and gas tip (6*b*) are separate from each other and extend along the longitudinal direction, Z. The dispense and gas tips (4*b*, 6*b*) must be sufficiently long, hard and sharp to penetrate and, if required, pierce the seals of corresponding dispense and gas openings (44, 66) of the closure (88). In FIGS. 2 to 5, the dispense and gas tips (4*b*, 6*b*) are illustrated as extending substantially normal to the dispense and gas tubes (4, 6). Whilst this configuration is advantageous, other geometries are possible, including tips (4*b*, 6*b*) extending coaxially with the corresponding dispense and gas tubes (4, 6). For hygiene reasons, it is particularly preferred that the dispense connector (4*a*) comprises a dispense tip (4*b*) which can be replaced with every new dispense tube (4) and keg, such that the whole flow path of the beverage from the keg to the dispense end (4*c*) of the dispense tube (4) be free of bacteria and dirt from previous kegs.

The dispense and gas connectors (4*a*, 6*a*) can be coupled to the keg connector (1) and, in particular, to the support element (13) by any quick, fluid tight, and reversible means. In particular, snap fittings are preferred, but bayonets, screw nuts, or a system of latch or securing pin can also be used. In a preferred embodiment, neither the keg base body (1*a*) nor the dispense and gas connectors (4*a*, 6*a*) comprise any sealing element. This is possible provided the closure (88) comprises appropriate sealing elements at the dispense and gas openings (44, 66) thereof. Examples of closures comprising such sealing elements are disclosed in WO2009/090224, which content is incorporated herein by reference.

The keg connector (1) of the present invention allows the fast and reliable connection to a keg (8), in particular to a bag-in-container keg, of a dispense tube (4) and a gas tube (6). With a single move of the actuation means, in particular of a lever (15), the keg connector is firmly fixed to the keg neck (8*a*), preferably provided with a collar, or to the keg closure (88). This easy to use keg connector is particularly suitable for kegs which are stored under the counter with no easy access, or for specialty beers being stored in kegs of smaller dimensions which must be changed more often than large, e.g., 50 l kegs.

The invention claimed is:

1. A keg connector for fluidly connecting the interior of a bag-in-container type of keg with a dispensing tube connected to a dispensing valve in a tapping column, and with a pressure gas tube connected to a source of pressurized gas, said keg connector comprising a base body and further comprising the following elements:

(a) a coupler for firmly and releasably coupling the keg connector to a neck of a keg or to a closure of said keg;

(b) a dispense connector comprising a substantially straight dispense tip extending along a longitudinal axis, Z, in fluid communication with a second end connected or connectable to a dispense tube in fluid communication with a tapping column and valve;

(c) a gas connector, comprising a substantially straight gas tip extending along said longitudinal axis, Z, and physically separate from the dispense tip, said gas tip being in fluid communication with a second end connected to a gas tube connectable to a source of pressurized gas;

(d) a coupling actuator for reversibly bringing the coupler from an uncoupled to a coupled position, in which the keg connector is firmly coupled to the keg neck or keg closure, with the dispense tip and gas tip facing corresponding dispense opening and gas opening provided on said keg closure; and (e) a penetration actuator for simultaneously and reversibly moving by a given distance along the longitudinal axis, Z, the dispense tip and gas tip from a first retracted position, Z0, to a second connected position, Z2, wherein said distance is sufficient for the dispense tip and gas tip to penetrate into the corresponding dispense opening and gas opening provided on the keg closure, wherein the coupling actuator and the penetration actuator are a single actuator suitable for sequentially driving in a single movement: in a first step, firm coupling of the keg connector to the keg neck or keg closure followed, in a second step, by the penetration of the dispense tip and gas tip into the corresponding dispense and gas openings.

2. The keg connector according to claim 1, wherein the single actuator comprises a lever pivotally mounted on said base body.

3. The keg connector according to claim 1, wherein when the coupler has reached a coupled position, the dispense tip and gas tip have moved along the longitudinal axis, Z, by an intermediate distance Z1 <Z2, wherein said intermediate distance, Z1, is less than the distance required by the dispense tip and gas tip to fully penetrate through the corresponding dispense and gas openings of the keg's closure, and is thus insufficient for the tips to establish fluid communication with the interior of the keg.

4. The keg connector according to claim 1, wherein the coupler comprises a first and second latches pivotally mounted on hinges disposed on opposite sides of the keg connector base body, one free end of each of said latches ending in a protrusion extending towards each other, such that actuation of the single actuator varies the distance, D, separating the tips of each protrusion from an uncoupled distance, D0, greater than at least one dimension of the keg's neck or keg's closure, such that the keg connector can be freely moved in the longitudinal direction, Z, until reaching its coupling position to said keg, to a coupled distance, D1 <D0, smaller than a dimension of the keg's neck or keg's closure such that the keg connector is firmly fixed to said keg's neck or keg's closure.

5. The keg connector according to claim 1, wherein the dispense and gas connectors are supported on a support element movable in the longitudinal direction, Z, with respect the keg connector base body, said support element being interconnected with each latch, such that by moving the support element along the longitudinal direction, Z, from said retracted position, Z0, to said intermediate position, Z1, drives the latches to pivot about their respective hinges such that the distance between the tips of the latch protrusions is decreased from the uncoupled distance, D0, to the coupled distance, D1.

6. The keg connector according to claim 2, wherein when the coupler has reached a coupled position, the dispense tip and gas tip have moved along the longitudinal axis, Z, by an intermediate distance Z1 <Z2, wherein said intermediate distance, Z1, is less than the distance required by the dispense tip and gas tip to fully penetrate through the corresponding dispense and gas openings of the keg's closure, and is thus insufficient for the tips to establish fluid communication with the interior of the keg.

7. The keg connector according to claim 6, wherein the coupler comprises a first and second latches pivotally mounted on hinges disposed on opposite sides of the keg connector base body, one free end of each of said latches ending in a protrusion extending towards each other, such that actuation of the single actuator varies the distance, D, separating the tips of each protrusion from an uncoupled distance, D0, greater than at least one dimension of the keg's neck or keg's closure, such that the keg connector can be freely moved in the longitudinal direction, Z, until reaching its coupling position to said keg, to a coupled distance, D1 <D0, smaller than a dimension of the keg's neck or keg's closure such that the keg connector is firmly fixed to said keg's neck or keg's closure.

8. The keg connector according to claim 7, wherein the dispense and gas connectors are supported on a support element movable in the longitudinal direction, Z, with respect the keg connector base body, said support element being interconnected with each latch, such that by moving the support element along the longitudinal direction, Z, from said retracted position, Z0, to said intermediate position, Z1, drives the latches to pivot about their respective hinges such that the distance between the tips of the latch protrusions is decreased from the uncoupled distance, D0, to the coupled distance, D1.

9. The keg connector according to claim 8, wherein moving the support element further along the longitudinal direction, Z, from said intermediate position, Z1, to said connected position, Z2, does not vary the coupled distance, D1, between the tips of the latch protrusions.

10. The keg connector according to claim 9, wherein the interconnection between the support element and the latches is in the form of either:

(a) a curved sliding surface of the latches engaged in corresponding openings of the support element, (b) a pin provided on the support element engaged in an opening in the shape of a curved bean slot provided on a latch, or (c) a pin provided on a latch engaged in an opening in the shape of a curved bean slot provided on the support element, the geometries of the bean shaped slots or sliding surfaces are such that the linear movement of the support element along the longitudinal axis, Z, generates the pivoting movement of the latches.

11. The keg connector according to claim 10, wherein the single actuator is a lever, one end being hinged at the keg connector base body, the second, opposite end being free, and in between the two lever ends, the lever is coupled to the support element supporting the dispense and gas connectors such that raising or lowering the free end of the lever raises or lowers said support element along the longitudinal axis, Z, between the retracted and connected positions, Z0 and Z2.

12. The keg connector according to claim 11, wherein each latch is pivotally mounted on a hinge in its intermediate section comprised between the two ends thereof, thus defining a first, lower latch section comprised between the hinge and the end provided with the protrusion, and a second, upper latch section comprised between the hinge and the latch second end, said second, upper section comprising a sliding surface having a specific curvature, the second, upper section of each latch being inserted in a slot provided on the support element supporting the dispense and gas connectors, such that as the slots receiving the second section of each latch move along the longitudinal axis, Z, they slide along the curved surface of the second, upper section of each latch, the slots and sliding surfaces having a geometry and dimensions such that as the support element moves from the retracted position, Z0, to the intermediate position, Z1, the tip of the latch protrusions is brought closer together from an uncoupled distance, D0 to a coupled distance, D1, and such that as the support element further moves along from the intermediate position, Z1, to the connected position, Z2, the latches do not pivot anymore.

13. The keg connector according to claim 11, wherein each latch comprises in its portion comprised between the two ends, either:

(a) a bean shaped slot engaged in a pin, said pin being mechanically coupled to the support element supporting the dispense and gas connectors, or (b) a pin engaged in a bean shaped slot, said bean shaped slot being provided on the support element supporting the dispense and gas connectors;

the bean shaped slot according to geometries (a) or (b) having:

a curved portion, such that the relative movement in the Z-direction between positions Z0 and Z1 of the pins running along the curved portion of said bean shaped slots drives the pivoting of the latches, and a substantially straight portion, such that the relative movement in the Z-direction between positions Z1 and Z2 of the pins running along the straight portion of said bean shaped slots does not affect the position of the latches.

14. The keg connector according to claim 13, wherein the latches are hinged at their respective ends opposite the ends comprising a protrusion, and the pins or bean shaped slots are provided in the intermediate portion comprised between the two ends.

15. The keg connector according to claim 13, wherein each latch is hinged in its intermediate section comprised between the two ends thereof, thus defining a first, lower latch section comprised between the hinge and the end provided with the protrusion, and a second, upper latch section comprised between the hinge and the latch second end, said second, upper section is provided with a pin or a bean shaped slot.

16. A beverage dispensing device comprising:

(a) a keg containing a beverage and comprising a closure provided with a dispense opening separate from a gas opening, (b) a source of pressurized gas in fluid communication with the keg by a gas tube, (c) a tapping column comprising a tapping valve in fluid communication with the keg by a dispense tube, wherein the dispense tube and gas tube are coupled to the keg by a keg connector for fluidly connecting the interior of a bag-in-container type of keg with a dispensing tube connected to a dispensing valve in a tapping column and with a pressure gas tube connected to a source of pressurized gas, said keg connector comprising a base body and further comprising the following elements:

(a) a coupler for firmly and releasably coupling the keg connector to a neck of a keg or to a closure of said keg;

(b) a dispense connector comprising a substantially straight dispense tip extending along a longitudinal axis, Z, in fluid communication with a second end connected or connectable to a dispense tube in fluid communication with a tapping column and valve;

(c) a gas connector comprising a substantially straight gas tip extending along said longitudinal axis, Z, and physically separate from the dispense tip, said gas tip being in fluid communication with a second end connected to a gas tube connectable to a source of pressurized gas;

(d) a coupling actuator for reversibly bringing the coupler from an uncoupled to a coupled position, in which the keg connector is firmly coupled to the keg neck or keg closure, with the dispense tip and gas tip facing corresponding dispense opening and gas opening provided on said keg closure, (e) a penetration actuator for simultaneously and reversibly moving by a given distance along the longitudinal axis, Z, the dispense tip and gas tip from a first retracted position, Z0, to a second connected position, Z2, wherein said distance is sufficient for the dispense tip and gas tip to penetrate into the corresponding dispense opening and gas opening provided on the keg closure, wherein coupling actuator and a penetration actuator are a single actuator suitable for sequentially driving in a single movement:

in a first step, firm coupling of the keg connector to the keg neck or keg closure followed, in a second step, by the penetration of the dispense tip and gas tip into the corresponding dispense and gas openings.

17. The keg connector according to claim 16, wherein the single actuator comprises a lever pivotally mounted on said base body.

18. The keg connector according to claim 17, wherein when the coupler has reached a coupled position, the dispense tip and gas tip have moved along the longitudinal axis, Z, by an intermediate distance Z1<Z2, wherein said intermediate distance, Z1, is less than the distance required by the dispense tip and gas tip to fully penetrate through the corresponding dispense and gas openings of the keg's closure, and is thus insufficient for the tips to establish fluid communication with the interior of the keg.

19. The keg connector according to claim 18, wherein the coupler comprises a first and second latches pivotally mounted on hinges disposed on opposite sides of the keg connector base body, one free end of each of said latches ending in a protrusion extending towards each other, such that actuation of the single actuator varies the distance, D, separating the tips of each protrusion from an uncoupled distance, D0, greater than at least one dimension of the keg's neck or keg's closure, such that the keg connector can be freely moved in the longitudinal direction, Z, until reaching its coupling position to said keg, to a coupled distance, D1<D0, smaller than a dimension of the keg's neck or keg's closure such that the keg connector is firmly fixed to said keg's neck or keg's closure.

20. The keg connector according to claim 19, wherein the dispense and gas connectors are supported on a support element movable in the longitudinal direction, Z, with respect the keg connector base body, said support element being interconnected with each latch, such that by moving the support element along the longitudinal direction, Z, from said retracted position, Z0, to said intermediate position, Z1, drives the latches to pivot about their respective hinges such that the distance between the tips of the latch protrusions is decreased from the uncoupled distance, D0, to the coupled distance, D1.

* * * * *